US005613309A

United States Patent [19]

Amsel et al.

[11] Patent Number: 5,613,309

[45] Date of Patent: Mar. 25, 1997

[54] STEAM IRON WITH STEAM GENERATING CHAMBER BAFFLE

[75] Inventors: Klaus Amsel, Oberursel; Albrecht Weller, Steinbach, both of Germany

[73] Assignee: Braun Aktiengesellschaft, Kronberg, Germany

[21] Appl. No.: 425,374

[22] Filed: Apr. 20, 1995

[30] Foreign Application Priority Data

Apr. 23, 1994 [DE] Germany ..... 44 14 221.8

[51] Int. Cl.[6] ..... D06F 75/18; D06F 75/38

[52] U.S. Cl. ..... 38/77.83; 38/93

[58] Field of Search ..... 38/74, 77.7, 72.8, 38/77.82, 77.83, 81, 93

[56] References Cited

U.S. PATENT DOCUMENTS

| | | | |
|---|---|---|---|
| 2,588,747 | 3/1952 | Morton | 38/77.83 |
| 2,757,464 | 8/1956 | Youhouse | 38/77.83 |
| 2,774,156 | 12/1956 | Parr | 38/77.83 |
| 2,815,592 | 12/1957 | Gomersall | 38/77.83 |
| 2,853,814 | 9/1958 | Brandler et al. | 38/77.83 |
| 3,694,942 | 10/1972 | Vondracek et al. | 38/77.83 |
| 4,091,551 | 5/1978 | Schaeffer | 38/77.83 |

FOREIGN PATENT DOCUMENTS

| | | | |
|---|---|---|---|
| 126809 | 2/1948 | Australia | 38/77.83 |
| 0267838 | 5/1988 | European Pat. Off. . | |
| 1316013 | 12/1962 | France . | |
| 2337780 | 1/1976 | France . | |
| 1978636 | 2/1968 | Germany . | |
| 2854917 | 6/1979 | Germany . | |
| 7921623 | 1/1980 | Germany . | |
| 2852165 | 6/1980 | Germany | 38/77.83 |
| 023037379 | 4/1982 | Germany . | |
| 3120785 | 7/1982 | Germany . | |
| 938519 | 10/1963 | United Kingdom . | |

*Primary Examiner*—Ismael Izaguirre
*Attorney, Agent, or Firm*—Fish & Richardson, P.C.

[57] ABSTRACT

The invention is directed to a steam iron comprising a soleplate (1) in which a steam generating chamber (2) is provided which is surrounded by a heating element (8) and communicates through a channel (10) with outlet ports (11) for the steam produced in the steam generating chamber (2), and further comprising a water reservoir arranged above the soleplate (1) and including in the area of the steam generating chamber (2) a drop dispensing device for the water to be evaporated, wherein a baffle device (13) is provided beneath the drop dispensing device, the baffle device having at least two oppositely inclined surfaces (15) sloping from the drop impingement location of the water to be evaporated in the direction of the heating element (8), effecting spreading of the water to both sides of the steam generating chamber (2).

22 Claims, 4 Drawing Sheets

STEAM IRON WITH STEAM GENERATING CHAMBER BAFFLE

FIELD OF INVENTION

This invention relates to a steam iron comprising a soleplate in which a steam generating chamber is provided which is surrounded by a heating element and communicates through a channel with outlet ports for the steam produced in the steam generating chamber, and further comprising a water reservoir arranged above the soleplate and including in the area of the steam generating chamber a drop dispensing device for the water to be evaporated.

BACKGROUND OF THE INVENTION

In the use of a steam iron of the type referred to in the steam mode, there occurs the problem of uneven temperature distribution on the soleplate. In the area where the water to be evaporated is dispensed dropwise, the bottom of the steam generating chamber is subjected to severe cooling as a result of heat abstraction caused by the evaporating action. For reasons of construction, the drop impingement location is conventionally provided in the proximity of the pointed end of the soleplate. As a result, in the steam mode the temperature of the soleplate is relatively insufficient in the entire region near the forward point of the soleplate. This results in poor evaporation and a concomitant reduced production of steam, in addition to tending to produce the undesired effect that drops exit from the outlet ports of the steam conducting channels. Further, the ironing results are unsatisfactory, especially in the ironing of areas that are only accessible by the pointed end of the soleplate.

With the aim to improving evaporation in the steam generating chamber, a steam iron known from FR-A 2 337 780 provides beneath the drop dispensing device for the water to be evaporated an inclined surface which is formed by the bottom of the steam generating chamber and includes striations on which mineral deposits develop. Water strikes dropwise the upper end of the inclined surface directly above the heating element, evaporating in part already there or as it flows downwards and away from the heating element towards the forward end of the steam chamber. Also in this arrangement, the water to be evaporated invariably strikes the same location in the forward portion of the soleplate, causing relatively severe cooling of this portion and producing an adverse temperature difference relative to other portions of the soleplate.

It is an object of the present invention to configure in a steam iron of the type initially referred to the introduction of water into the steam generating chamber in such a fashion that in the steam mode the temperature is as uniform as possible in all portions of the soleplate.

SUMMARY OF THE INVENTION

According to the present invention, this object is accomplished in that a baffle device is provided beneath the drop dispensing device, the baffle device having at least two oppositely inclined surfaces sloping from the drop impingement location of the water to be evaporated in the direction of the heating element.

In the steam iron of the present invention, the drops of water discharged from the drop dispensing device strike the baffle device in the steam generating chamber, the baffle device dividing these drops and causing them to flow along at least two sides to the heating element surrounding the steam generating chamber. This has the advantage that the water contacts the heating element directly, which is accomplished by spreading the drops to various locations on the heating element, rather than to only one location. By virtue of the direct contact with the heating element on the one hand and the reduced amount of water at the individual evaporation points on the other hand, a more effective evaporation and a reduced heat abstraction at the points of evaporation results. This has the effect of producing a more uniform temperature distribution on the soleplate, in addition to enabling a sufficient amount of steam to be produced also at a relatively low soleplate temperature.

In an advantageous embodiment of the steam iron of the present invention, the surfaces of the baffle device are inclined to the side related to the longitudinal direction of the soleplate. As a result, the water is spread to both sides of the steam generating chamber also as the iron is moved during a pressing action. In addition, the surfaces of the baffle device may be inclined in the same longitudinal direction of the soleplate in order to obtain the effect that the main evaporation point is relocated farther to the front or to the rear as viewed from the drop impingement location. For example, if the baffle device is inclined such that the water is primarily directed to the rear, the main evaporation point is more distal from the pointed end of the soleplate. The temperature then prevailing in the entire forward portion of the soleplate is higher, differing less from the other areas of the soleplate, because the heat abstraction is spread over larger surface areas in the center of the soleplate.

In a preferred embodiment of the steam iron of the present invention, the baffle device has the form of a gable roof whose ridge is located beneath the drop dispensing location. The ridge of the gable roof may be oriented in parallel to the soleplate surface or at an inclination thereto, sloping to the rear, for example. It will be understood, however, that the baffle device may also be shaped in the manner of a dome, a cone or a pyramid. This may be convenient in cases where the position of the steam generating chamber or the configuration of the heating element make it desirable to spread the water in more than two directions.

A steam iron configuration affording particular ease and economy of manufacture is obtained if the baffle device is made from a piece of sheet metal inserted into the steam generating chamber. This embodiment is especially suitable for retrofitting existing steam irons with a baffle device without the need to alter the design of the steam iron.

In a further feature of the present invention, the baffle device is formed by the bottom of the steam generating chamber. Owing to a phenomenon referred to as the Leidenfrost phenomenon according to which drops of water, rather than evaporating immediately on a hot surface, float on a developing steam cushion, a small inclination of the surfaces of the order of 5 to 10 degrees, approximately, is sufficient to make the water flow to the heating element. Moreover, it is an advantage if the surface of the steam generating chamber at the evaporation points is coated with a material enhancing the evaporating action.

To obtain a uniform temperature distribution on the soleplate, the present invention may further provide for the soleplate to be comprised of two parts, and for the steam generating chamber and/or the heating element to be thermally decoupled from a separate soleplate component wholly or in part. Decoupling may be provided preferably at especially hot or cold spots in the area of the soleplate body portion. According to the present invention, such local decoupling may be accomplished by the provision of insulating inserts or cavities between the hot or cold spots and the soleplate component.

Embodiments of the present invention will be described in more detail in the following with reference to the accompanying drawings.

DESCRIPTION OF THE PREFERRED EMBODIMENT

Figure 1:
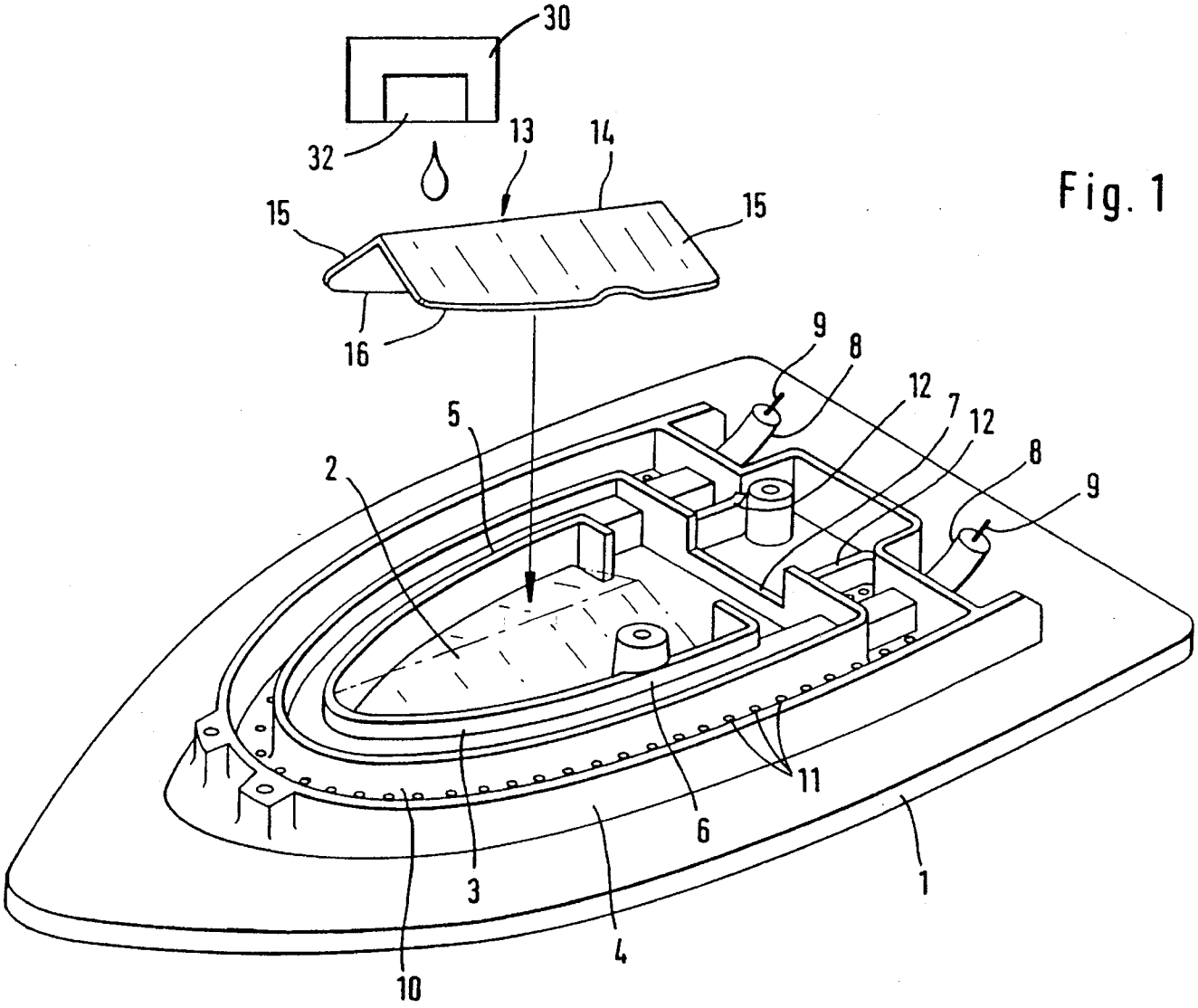
FIG. 1 is a perspective view of a soleplate of a steam iron of the present invention with a baffle device inserted.

Referring now to FIG. 1 of the drawings, there is shown a steam iron soleplate 1 configured as a plane panel. Provided in the center of the soleplate 1 is a steam generating chamber 2 surrounded by an inner rib 3 and an outer rib 4 arranged in spaced relation thereto. The inner rib 3 is shaped in the manner of U, with the legs 5, 6 of the U pointing to the rear. Between the ends of the legs 5, 6, a connecting ledge 7 is provided forming a barrier against the outflow of water from the steam generating chamber 2. Extending within the inner rib 3 is an electrical heating element 8, with the ends of the heating element 8 projecting rearwardly out of the legs 5, 6 and having respective terminals 9 for connection to an electricity supply.

The outer rib 4 forms a ring enclosure, providing a boundary for a steam conducting channel 10 which extends between the inner rib 3 and the outer rib 4 and includes steam outlet ports 11 opening to the soleplate 1. The area of the steam conducting channel 10 including the outlet ports is bounded relative to the steam generating chamber 2 by means of cross members 12. The cross members 12 provide a second barrier against the ingress of water into the steam conducting channel 10.

Figure 2:
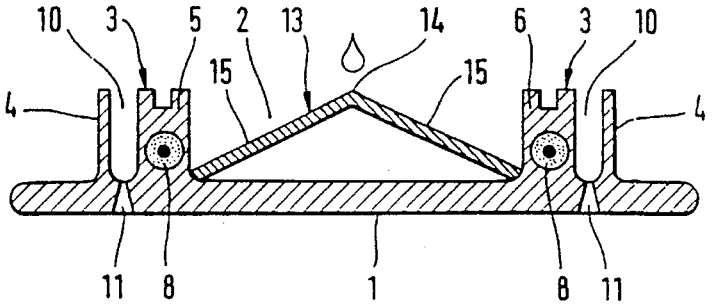
FIG. 2 is a cross-sectional view of the steam iron of FIG. 1.
Figure 7:
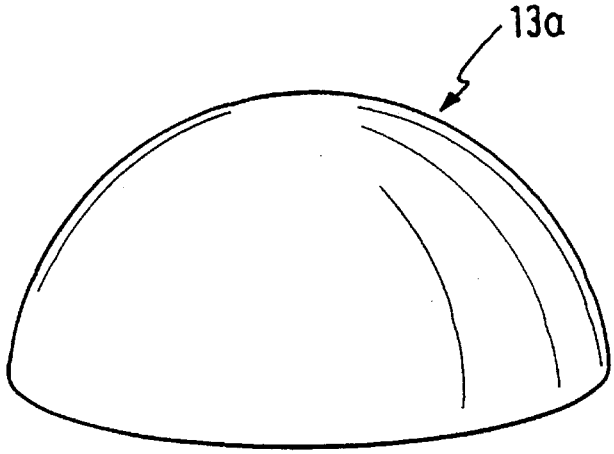
FIG. 7 is a perspective view of a baffle device shaped in the manner of a dome.
Figure 8:
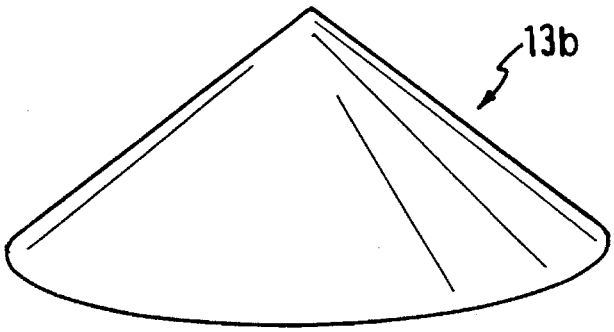
FIG. 8 is a perspective view of a baffle device shaped in the manner of a cone.
Figure 9:
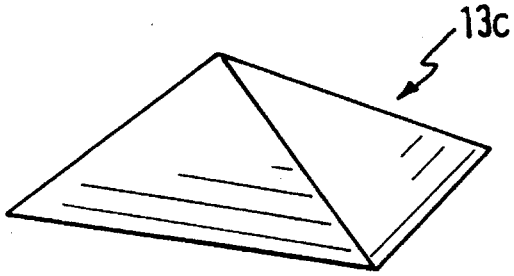
FIG. 9 is a perspective view of a baffle device shaped in the manner of a pyramid.

A baffle device 13 is insertable into the steam generating chamber 2. The baffle device 13 is formed from sheet metal and has the shape of a gable roof whose ridge 14 is oriented essentially parallel to the soleplate surface. The two side surfaces 15 of the roof-shaped baffle device 13 are inclined in relatively opposite directions, their lower edges 16 resting on the soleplate 1 in the inserted condition, as illustrated in FIG. 2. The ends of the edges 16 bear against the inner rib 3. In this manner, the baffle device 13 is positioned in its proper location relative to the steam generating chamber 2. FIGS. 7–9 show the baffle device alternatively shaped in the manner of a dome 13*a*, cone 13*b* and pyramid 13*c*, respectively.

Arranged above the steam generating chamber 2 is a water reservoir 30 which includes a drop dispensing device 32 whose discharge orifice is located above the ridge 14, approximately in the center thereof. As a result, exiting water drops strike primarily the ridge 14 of the baffle device 13 where they are divided, flowing down along both side surfaces 15 of the baffle device 13. In this manner, the water is directed to both sides of the steam generating chamber 2, reaching immediately the legs 5, 6 of the inner rib 3 heated by the heating element 8 where it is evaporated. Accordingly, water is converted into steam in essentially two equal amounts by two relatively spaced portions of the heating element 8, so that the heating element 8 is cooled to a lesser degree and a higher steam rate is accomplished by reason of an increased energy supply. A concentrated zone in the area of the drop impingement location is avoided, resulting in a substantially more uniform temperature distribution on the soleplate 1.

The baffle device 13 takes effect also as the steam iron is moved during the pressing action. During ironing, the drops of water, while not consistently striking the ridge 14, also impinge directly on the side surfaces 15. However, since the direction of movement varies continuously, there results overall a distribution of the water drops to both sides of the steam generating chamber 2.

Figure 3:
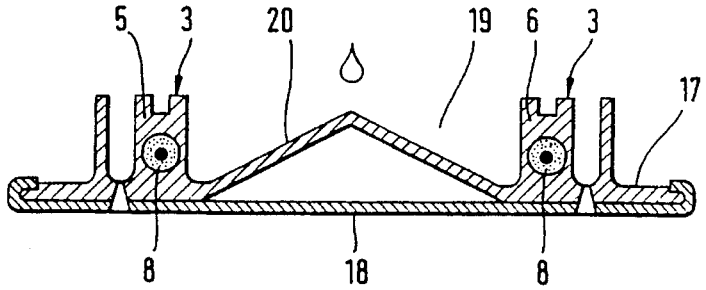
FIG. 3 is a cross-sectional view of a thermally decoupled soleplate of a steam iron of the present invention.

FIG. 3 shows a soleplate 17 having a soleplate component 18 attached to its underside. Owing to its twopart configuration, a parting line results between the soleplate 17 and the soleplate component 18, thermally decoupling the soleplate component 18 from the soleplate 17. Except for the bottom of the steam generating chamber 19, the upper side of the soleplate 17 is configured in the same manner as the soleplate 1 of FIG. 1. The bottom 20 of the steam generating chamber 19 is roof-shaped, providing a baffle device corresponding in its effect to the baffle device 13 of FIGS. 1 and 2. By reason of the integral formation of the bottom 20 with the inner rib 3 comprising the heating element 8, the bottom 20 becomes hotter than the loosely inserted baffle device 13. Yet, evaporation occurs substantially on the legs 5, 6 of the inner rib 3 because, due to the Leidenfrost phenomenon, the water drops float on a developing steam cushion, rolling downwards, rather than evaporating immediately on the bottom 20. In this embodiment, thermal decoupling prevents temperature variations occurring on the soleplate 17 from being transferred to the soleplate component 18 to the same degree, resulting in a particularly uniform temperature distribution on the soleplate component 18.

Figure 4:
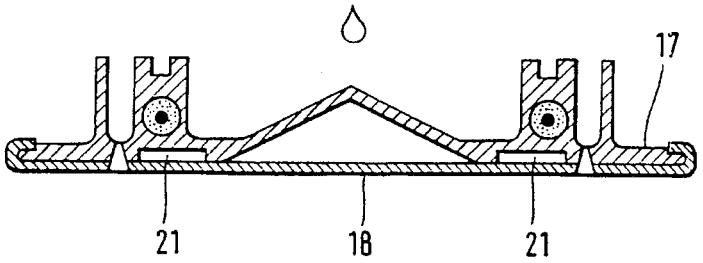
FIGS. 4 and 4A are cross-sectional views of a thermally decoupled soleplate of a steam iron according to alternate embodiments of the present invention, providing for additional local decoupling.
Figure 4A:
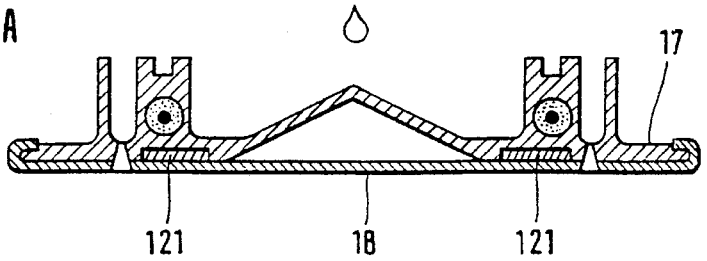

The embodiment of FIG. 4 corresponds substantially to the embodiment illustrated in FIG. 3. In addition, however, it provides recesses 21 in the underside of the soleplate 17 to thermally decouple the soleplate component 18 locally at particularly hot spots in the soleplate which are directly beneath the heating element 8. This enables temperature variations on the soleplate component 18 to be reduced to a still greater extent. Alternatively, insulating inserts 121 may be provided, as shown in FIG. 4*a*, to thermally decouple the soleplate component.

Figure 5:
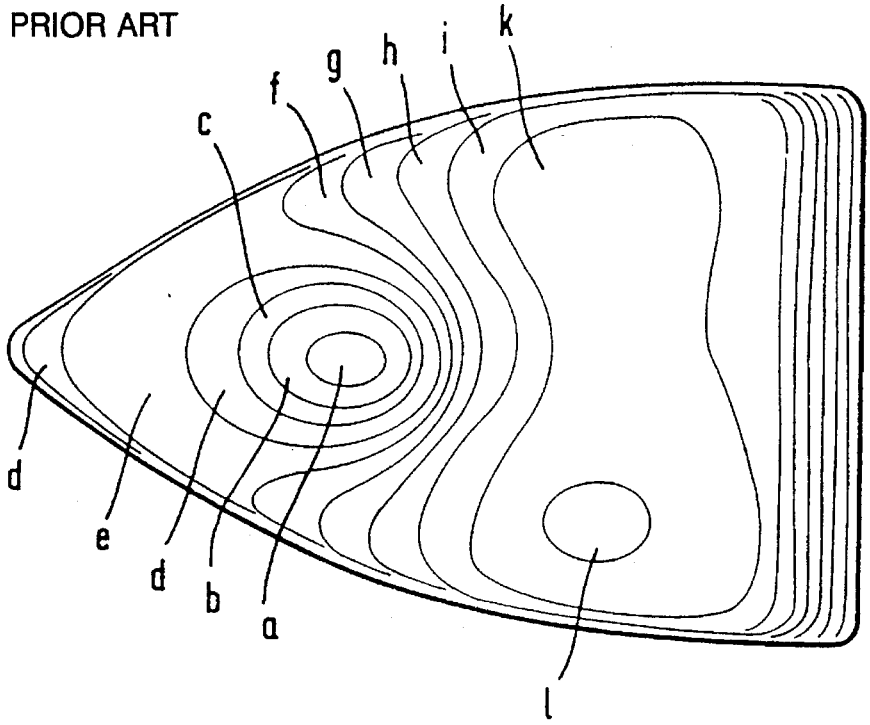
Fig. 5 PRIOR ART
FIG. 5 is a view of the soleplate of a conventional steam iron showing the temperature distribution pattern in the steam mode.
Figure 6:
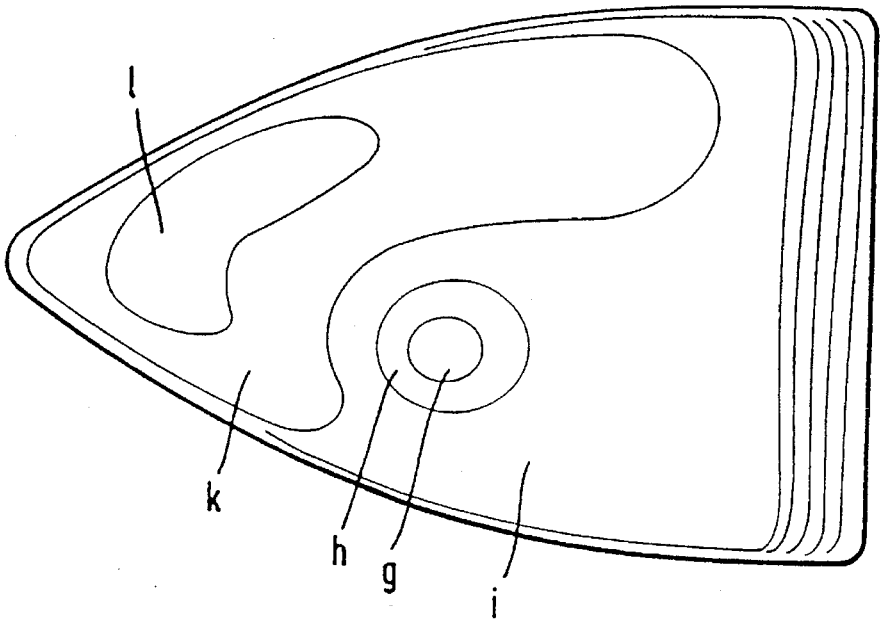
FIG. 6 is a view of the soleplate of a steam iron of the present invention showing the temperature distribution pattern in the steam mode.

The advantages obtainable with the present invention will become apparent from FIGS. 5 and 6 showing the temperature distribution pattern measured in a conventional steam iron (FIG. 5) and in a steam iron constructed in accordance with the present invention (FIG. 6). The Figures show the temperature fields measured on the soleplate surface of the two steam irons. The measurements were made with the irons in the steam mode at the highest temperature setting and at the maximum steam rate. The temperature fields identified by a to l correspond to the following temperature ranges:

a=102° to 113° C.

b=113° to 123° C.

c=123° to 134° C.

d=134° to 145° C.

e=145° to 155° C.

f=155° to 165° C.

g=165° to 176° C.

h=176° to 186° C.

i=186° to 197° C.

k=197° to 207° C.

l=207° to 218° C.

In the conventional steam iron shown in FIG. 5, the soleplate surface shows a severely cooled area in the temperature field a beneath the drop impingement location, as result of which the temperature of the entire forward portion of the soleplate (temperature fields a, b, c, d and e) does not exceed 155° C., which is thus far below the temperature desired for ironing. The maximum temperature is measured in field l, in the rear portion of the soleplate surface, where it is between 207° and 218° C. The temperature difference on the soleplate surface between the coolest temperature field a and the hottest temperature field l is thus 100° C., approximately.

By contrast, in the steam iron of the present invention shown in FIG. 6, the lowest temperature is measured in the temperature field g corresponding to a range from 165° to 176° C., which is thus only about 40° C. below the temperature in the hottest area, which is the temperature field 1. It becomes apparent further that a very large area of the soleplate surface, that is, the temperature fields i and k, lies in a narrow temperature range with a difference of 21° C., maximum. Moreover, owing to the use of the baffle device of the invention, the high-temperature areas (temperature fields l and k) occur in the forward portion of the soleplate and not in the rear portion.

Thus, the effective temperature difference between the various areas of the soleplate surface is substantially lower in the steam iron of the present invention than in the conventional steam iron. Large areas of the soleplate surface have a relatively uniform temperature, and the area where the temperature is lowest is restricted to a very small portion of the soleplate surface. The temperature in the forward portion of the soleplate which finds particular utility in the ironing of corners, edges and creases, corresponds to the selected temperature setting, thus facilitating the smoothing of these areas which are only accessible with the pointed end of the soleplate.

What is claimed:

1. A steam iron comprising:

a soleplate having a plurality of outlet ports;

a soleplate component attached to the soleplate and thermally decoupled from the soleplate;

a steam generating chamber provided in the soleplate, the steam generating chamber communicating through a channel with the outlet ports, whereby steam produced in the steam generating chamber is channeled to the outlet ports;

a heated rib member surrounding the steam generating chamber;

a water reservoir arranged above the soleplate and including a drop dispensing device in the area of the steam generating chamber, whereby the drop dispensing device drops water to be evaporated into the steam generating chamber; and a baffle device provided within said steam generating chamber and beneath the drop dispensing device, the baffle device having a drop impingement location where water dropped by the drop dispensing device impinges, the baffle device having at least two oppositely inclined surfaces sloping from the drop impingement location into the heated rib member.

2. The steam iron as claimed in claim 1 wherein relatively hot or cold spots of the soleplate are thermally decoupled from the soleplate component locally.

3. The steam iron as claimed in claim 2 wherein local thermal decoupling is accomplished by the provision of cavities between the relatively hot or cold spots in the soleplate and the soleplate component.

4. The steam iron as claimed in claim 2 wherein local thermal decoupling is accomplished by the provision of insulating inserts between the relatively hot or cold spots of the soleplate and the soleplate component.

5. The steam iron as claimed in claim 1 wherein the steam generating chamber is thermally decoupled from the soleplate component.

6. The steam iron as claimed in claim 1 wherein the heated rib member is thermally decoupled from the soleplate component.

7. A steam iron comprising:

a soleplate having a plurality of outlet ports;

a steam generating chamber provided in the soleplate, the steam generating chamber communicating through a channel with the outlet ports, whereby steam produced in the steam generating chamber is channeled to the outlet ports;

a heated rib member surrounding the steam generating chamber;

a water reservoir arranged above the soleplate and including a drop dispensing device in the area of the steam generating chamber, whereby the drop dispensing device drops water to be evaporated into the steam generating chamber; and a baffle device provided within said steam generating chamber and beneath the drop dispensing device, the baffle device having a drop impingement location where water dropped by the drop dispensing device impinges, the baffle device having at least two oppositely inclined surfaces sloping from the drop impingement location into the heated rib member.

8. The steam iron as claimed in claim 7 wherein the soleplate has two sides oriented along a longitudinal direction of the soleplate, and the surfaces of the baffle device are inclined to the sides of the soleplate.

9. The steam iron as claimed in claim 8 wherein the soleplate has a front and a rear, and the surfaces of the baffle device are inclined in the longitudinal direction of the soleplate to the front and the rear.

10. The steam iron as claimed in claim 7 wherein the baffle device has the form of a gable roof.

11. The steam iron as claimed in claim 7 wherein the baffle device is shaped in the manner of a dome.

12. The steam iron as claimed in claim 7 wherein the baffle device is made from a piece of sheet metal inserted into the steam generating chamber.

13. The steam iron as claimed in claim 7 wherein the steam generating chamber has a bottom surface forming the baffle device.

14. The steam iron as claimed in claim 7 wherein the surfaces of the baffle device are inclined at an angle of 5 to 10 degrees relative to a plane formed by the soleplate.

15. The steam iron as claimed in claim 7 wherein the surface of the steam generating chamber near the heated member is coated with a material enhancing the evaporating action.

16. The steam iron as claimed in claim 7 wherein the heated rib member comprises a heating element.

17. The steam iron as claimed in claim 7 wherein the baffle device is shaped in the manner of a cone.

18. The steam iron as claimed in claim 7 wherein the baffle device is shaped in the manner of a pyramid.

19. The steam iron as claimed in claim 7 wherein said baffle device is positioned within a central region of said steam generating chamber.

20. A steam iron comprising:

a soleplate having a plurality of outlet ports;

a steam generating chamber provided in the soleplate, the steam generating chamber communicating through a channel with the outlet ports, whereby steam produced in the steam generating chamber is channeled to the outlet ports;

a heating element surrounding the steam generating chamber;

a water reservoir arranged above the soleplate and including a drop dispensing device in the area of the steam generating chamber, whereby the drop dispensing device drops water to be evaporated into the steam generating chamber; and a baffle device separate from said soleplate, disposed within said steam generating chamber and beneath the drop dispensing device, the baffle device having a drop impingement location where water dropped by the drop dispensing device impinges, the baffle device having at least two oppositely inclined walls joined at the drop impingement location, each wall having a surface downwardly sloping from the drop impingement location toward the direction of the heating element, said inclined walls defining a space above said soleplate and between the drop impingement location and said soleplate.

21. The steam iron as claimed in claim 20 wherein said inclined walls are formed of sheet metal.

22. A steam iron comprising:

a soleplate having a plurality of outlet ports;

a soleplate component attached to the soleplate and thermally decoupled from the soleplate;

a steam generating chamber provided in the soleplate, the steam generating chamber communicating through a channel with the outlet ports, whereby steam produced in the steam generating chamber is channeled to the outlet ports;

a heating element surrounding the steam generating chamber;

a water reservoir arranged above the soleplate and including a drop dispensing device in the area of the steam generating chamber, whereby the drop dispensing device drops water to be evaporated into the steam generating chamber; and a baffle device separate from said soleplate, disposed within said steam generating chamber and beneath the drop dispensing device, the baffle device having a drop impingement location where water dropped by the drop dispensing device impinges, the baffle device having at least two oppositely inclined walls joined at the drop impingement location, each wall having a surface downwardly sloping from the drop impingement location toward the direction of the heating element, said inclined walls defining a space above said soleplate and between the drop impingement location and said soleplate.

* * * * *

UNITED STATES PATENT AND TRADEMARK OFFICE

CERTIFICATE OF CORRECTION

PATENT NO. : 5,613,309

DATED : March 25, 1997

INVENTOR(S) : Klaus Amsel, Albrecht Weller

It is certified that error appears in the above-identified patent and that said Letters Patent is hereby corrected as shown below:

Col. 3, l. 15, delete "a".

Col. 3, l. 16, "soleplate" should be --soleplates--.

Signed and Sealed this

Fourth Day of May, 1999

*Attest:*

*Attesting Officer*

Q. TODD DICKINSON

*Acting Commissioner of Patents and Trademarks*